United States Patent [19]

Floreen

[11] 4,443,254

[45] Apr. 17, 1984

[54] COBALT FREE MARAGING STEEL

[75] Inventor: Stephen Floreen, Suffern, N.Y.

[73] Assignee: Inco Research & Development Center, Inc., Suffern, N.Y.

[21] Appl. No.: 202,674

[22] Filed: Oct. 31, 1980

[51] Int. Cl.[3] ..... C22C 38/06; C22C 38/08; C22C 38/12; C22C 38/14

[52] U.S. Cl. ..... 75/123 B; 75/123 H; 75/123 J; 75/123 K; 75/123 M; 75/124; 148/37

[58] Field of Search ..... 75/123 B, 123 J, 123 K, 75/123 H, 123 M, 123 R, 124; 148/37

[56] References Cited

U.S. PATENT DOCUMENTS

| | | | |
|---|---|---|---|
| 3,093,519 | 6/1963 | Decher et al. | 75/123 K |
| 3,243,285 | 3/1966 | Fragetta et al. | 75/123 K |
| 3,318,690 | 5/1967 | Floreen et al. | 75/123 |
| 3,392,065 | 7/1968 | Bieber et al. | 148/31 |

FOREIGN PATENT DOCUMENTS

| | | | |
|---|---|---|---|
| 1487202 | 6/1967 | France | 75/123 K |
| 46-935 | 1/1971 | Japan | 75/123 K |
| 55-131158 | 10/1980 | Japan | 75/123 K |
| 1355475 | 6/1974 | United Kingdom . | |

OTHER PUBLICATIONS

*Maraging Nickel Steels,* The International Nickel, pp. 1–9, (1962).

Article from Transactions Quarterly of the ASM, 1964, vol. 57, No. 3, Floreen, S. et al., pp. 714–726.

Article from Transactions of the ASM, 1964, vol. 57, S. Floreen; "Hardening Behavior of Ternary Alloys", pp. 38–47.

The International Nickel Co., Inc. Technical Service Letter of Mar. 2, 1962, "Annealing and Maraging 18%, 20% and 25% Ni Maraging Steels", pp. 1–7.

National Aeronautics & Space Administration–Survey NASA SP–5051 entitled The Metallurgy, Behavior, and Application of the 18–Percent Nickel Maraging Steels, pp. 1–3, 5–125, 127–137.

*Primary Examiner*—Michael L. Lewis

*Attorney, Agent, or Firm*—Raymond J. Kenny

[57] ABSTRACT

The subject invention is directed to ferrous-base alloys, particularly to a cobalt-free maraging steel of novel chemistry characterized by a desired combination of strength and toughness, notwithstanding that cobalt is non-essential.

4 Claims, No Drawings

COBALT FREE MARAGING STEEL

BACKGROUND OF THE INVENTION

As the artisan is aware, circa 1960, a new class of alloys steels were introduced, the steels being designated "maraging". These alloys were characterized by a low carbon, iron-nickel or iron-nickel-cobalt matrix which could be readily aged to deliver a high level of strength.

Initially, two types of maraging steels were proposed, one being an 18%–24% nickel-containing cobalt-free version invented by C. G. Bieber (U.S. Pat. No. 3,093,518), the other a nickel-cobalt-molybdenum material discovered by R. F. Decker et al (U.S. Pat. No. 3,093,519). The former class (cobalt-free) never gained commercial success of any importance and have witnessed little use. Among the reasons for this was the lack of toughness otherwise characteristic of the cobalt-containing variety at desired yield strengths. Since the cobalt-containing type manifested an acceptable level of toughness, these steels generated a substantial market. Schedule I sets forth the three standard nominal commercial compositions of the cobalt maraging steels together with approximate corresponding yield strength levels.

Schedule I

| Yield Strength psi | Co | Mo | Ni | Ti | Al | C |
|---|---|---|---|---|---|---|
| 200,000 | 8.5 | 3.25 | 18 | 0.2 | 0.1 | 0.03 max |
| 250,000 | 7.5 | 5.0 | 18 | 0.4 | 0.1 | 0.03 max |
| 300,00 | 9.0 | 5.0 | 18.5 | 0.6 | 0.1 | 0.03 max |

Given the foregoing, in recent years the price of cobalt has risen dramatically (reaching virtually prohibitive levels for steel manufacture). In addition, some uncertainty attends the sources of supply. As a consequence, the matter has reached such an acute stage that the market for maraging steels has greatly diminished. (The cobalt dilemna is common to many other alloys other than maraging steels.)

Accordingly, the problem from a metallurgical viewpoint was one of developing a high strength, maraging steel characterized by acceptable toughness (as well as tensile ductility and reduction of area) without recourse to the constituent cobalt which contributed to toughness of the standard maraging alloys.

It has now been discovered that if nickel, molybdenum, titanium, aluminum, carbon and other constituents are carefully balanced a maraging steel having the following properties in combination can be readily produced using conventional processing procedures:

i. yield strength, 240,000–250,000+ psi
ii. ultimate tensile strength, 260,000+ psi
iii. Charpy-V-Notch toughness, 10–15+ ft.lbs. at yield strengths on the order of 250,000 psi
iv. tensile ductility, about 8–10% or higher
v. reduction in area, about 35–45% note: properties based upon 1" diameter bar. A number of compositions significantly exceed the above combination of properties.

Generally speaking, the present invention contemplates a maraging steel containing about 17% to 19% nickle, about 1% to 4% molybdenum, about 1.25% to 2.5% titanium, a small but effective amount of aluminum and up to about 0.25% or 0.3%, carbon up to 0.03%, the balance being essentially iron. As will be understood by those skilled in the art, the term "balance" or "balance essentially" when used in reference to the constituent iron does not exclude the presence of other elements commonly present as incidentals, e.g., deoxidizing and cleaning elements, and impurities ordinarily present in such steels in small amounts which do not materially adversely affect the basic characteristics of the subject alloy. Elements such as oxygen, hydrogen, sulfur, nitrogen and the like should be maintained at low levels consistent with good steel making practice. Auxiliary elements can be present such as tantalum, tungsten, vanadium and columbium. If present, these constituents need not be present in amounts above 2% each. In this connection, I have found that columbium may detract from toughness and vanadium offers little to warrant the added cost. Boron, zirconium and calcium can also be utilized. These elements need not exceed about 0.25% each. Manganese and silicon should not exceed 1%, respectively.

In carrying the invention into practice, the nickel content should not fall much below 17%. It is recognized lower percentages have been heretofore advanced but it has been found that even a level of 15% is detrimental, as will be shown infra, particularly in terms of toughness. (This is rather unusual based on the behavior of many other maraging steels.) Though a nickel content of say 16.5% could be used in certain applications, propertywise nothing is to be gained. While the upper nickel level can be extended to 21%, a loss of strength can be expected. I have found that at roughly 23–24% there is a most substantial loss in strength. This is likely attributable to untransformed austenite. For consistently achieving best results, the nickel content should not exceed 19%.

With regard to molybdenum, it imparts toughness, and to a lesser extent strength upon aging. In the cobalt-containing maraging steels, the literature indicates there apparently is an interaction between cobalt and molybdenum which lends to or is largely responsible for the properties characteristic of those steels. In respect of the subject steel and as mentioned supra, a still high level of toughness and strength obtains absent the effect of cobalt. In any case, an insufficient amount of molybdenum, it has been found, markedly detracts from toughness. And while the percentage of this constituent can be extended downward to 0.5% in marginal cases, it is much preferable to use at least 1%. Percentages above 4% do not impart any additional virtue commensurate with the added cost. A range of 2% to 3.5% is particularly satisfactory for most contemplated applications.

Titanium at the levels contemplated is a potential hardener upon aging. The percentage of this constituent should not fall below the 1.25% level; otherwise, strength is adversely affected. Amounts above 2.5% tend to introduce segregation difficulties. A range of 1.4 to 1.7% is highly satisfactory. Another suitable range is from 1.8 to 2.1%.

In addition to the foregoing, the respective percentages of molybdenum and titanium are deemed interdependent and should be correlated such that when the molybdenum content is less than about 1.5%, the titanium content should be 1.8% or more. And when the titanium is less than about 1.5%, the percentage of molybdenum should be at least about 2.25% and preferably 2.5% and above. This correlation is particularly advantageous in consistently providing for excellent combinations of strength and toughness.

Turning to the element carbon, it should not exceed 0.05%; otherwise, toughness is needlessly subverted. In seeking optimum results the carbon content should not exceed 0.03%. Aluminum is used principally for deoxidizing purposes. While amounts up to 1% could be used, it is deemed beneficial that it not much exceed about 0.3%. It is considered that from 0.05 to 0.15% will suffice in most instances.

With regard to processing, air melting practices can be employed though it is preferred that vacuum melting, e.g., vacuum induction melting, be used. This can be followed by vacuum arc remelting. Zirconium, boron, calcium and also magnesium can be used for deoxidizing and/or malleabilizing purposes.

Prior to aging, the instant steel should be solution annealed at a temperature of from about 1400° F. to 1600° F., this range contributing to a satisfactory martensitic structure upon cooling. Excellent results follow from aging at temperatures of 850° F. to 950° F. for up to five hours. An age at 900° F. for 3 hours has been found quite acceptable.

The following data are offered to give those skilled in the art a general perspective of the results to be expected from compositional modifications.

Thirty pound vacuum induction melts were made in respect of the compositions given in Table I. The cast ingots were soaked at 2300° F. for three hours and then hot rolled to 2"×2" bar and cooled to room temperature. The samples were reheated to 2000° F., held thereat for two hours, and then hot rolled to one-inch diameter bars. This was followed by solution annealing at 1500° F. for one hour, air cooling to ambient temperature, and then aging 3 hours at 900° F. followed by air cooling. The bars were then tested, the results being reported in Table II. Alloys A through E are without the invention.

TABLE I

| | | Chemical Compositions | | | | |
|---|---|---|---|---|---|---|
| Alloy | Ni % | Mo % | Ti % | Al % | C % | Others % |
| 1 | 18.1 | 1.0 | 1.8 | 0.08 | 0.008 | none |
| 2 | 17.1 | 2.0 | 1.82 | 0.07 | 0.014 | none |
| 3 | 17.5 | 2.1 | 2.0 | 0.12 | 0.013 | 2.0V |
| 4 | 18.1 | 2.2 | 2.5 | 0.11 | 0.029 | none |
| 5 | 21.0 | 2.1 | 1.9 | 0.13 | 0.010 | none |
| 6 | 17.8 | 0.64 | 2.03 | 0.08 | 0.018 | none |
| 7 | 17.4 | 1.44 | 1.9 | 0.08 | 0.013 | none |
| 8 | 18.1 | 3.1 | 1.4 | 0.05 | 0.002 | none |
| 9 | 17.9 | 3.1 | 1.4 | 0.07 | 0.019 | 0.90V |
| 10 | 17.8 | 3.1 | 1.1 | 0.05 | 0.007 | 0.33W, 1.0V |
| A | 17.5 | n.a. | 2.06 | 0.09 | 0.023 | 1.9V |
| B | 17.3 | n.a. | 1.07 | 0.10 | 0.025 | 1.8V, 2.5Cb |
| C | 15.3 | 1.4 | 2.1 | 0.12 | 0.023 | none |
| D | 23.7 | 2.1 | 2.0 | 0.12 | 0.024 | none |
| E | 17.9 | 0.30 | 1.95 | 0.10 | 0.016 | none |
| F | 15.7 | 2.0 | 1.98 | 0.10 | 0.024 | none |

Balance Fe and impurities

TABLE II

| | Mechanical Properties | | | | |
|---|---|---|---|---|---|
| Alloy | Yield Strength, psi | Ultimate Tensile Strength, psi | Elongation, % | Reduction Area, % | CVN, Impact Energy ft/lbs |
| 1 | 252,000 | 267,000 | 9 | 47 | 16.2 |
| 2 | 272,000 | 286,000 | 10 | 49 | 17.0 |
| 3 | 290,000 | 303,000 | 10 | 45 | 13.7 |
| 4 | 291,000 | 309,000 | 5 | 34 | 10.2 |
| 5 | 241,000 | 274,000 | 6 | 33 | 13.7 |

TABLE II-continued

| | Mechanical Properties | | | | |
|---|---|---|---|---|---|
| Alloy | Yield Strength, psi | Ultimate Tensile Strength, psi | Elongation, % | Reduction Area, % | CVN, Impact Energy ft/lbs |
| 6 | 251,000 | 269,000 | 10 | 46 | 14.5 |
| 7 | 202,000 | 238,000 | 12 | 53 | 22.7 |
| 8 | 249,000 | 257,000 | 13 | 58 | 24.5 |
| 9 | 251,000 | 264,000 | 10 | 41 | 18.7 |
| 10 | 245,000 | 254,000 | 12 | 52 | 24.7 |
| A | 251,000 | 282,000 | 6 | 19 | 6.5 |
| B | 251,000 | 257,000 | 8 | 36 | 8.5 |
| C | 260,000 | 278,000 | 4 | 24 | 3.0 |
| D | 46,000 | 114,000 | 34 | 59 | 23.0 |
| E | 243,000 | 258,000 | 9 | 52 | 7.0 |
| F | 250,000 | 268,000 | 10 | 48 | 6.7 |

As can be observed from the above data, the alloy compositions within the invention afford an highly attractive combination of properties, the absence of cobalt notwithstanding. Alloy 3 reflects that even at a tensile strength at 300,000 psi, a Charpy-V-Notch impact energy level of 10 ft-lbs or more is possible with such a balanced chemistry. In marked contrast, molybdenum-free steels A and B manifested inferior toughness. Columbium-containing Alloy B did not appreciably offset this disadvantage, the yield strengths being the same. (In general, colombium, vanadium and tungsten added little benefit.) Alloy D (23.7% Ni) exhibited a significantly inferior strength level, this being due to a large amount of retained austenite upon cooling from the aging temperature. On the other hand, an insufficient amount of nickel (Alloy C, 15.3% Ni) detracted from toughness. Alloy 7 is an anomalous result not understood at this time.

The alloy of the invention is deemed useful for tool and die applications, including pinion shafts, bit-forging dies, cold-heading dies and cases, gears, cams, clutch discs, drive shafts, etc. It is also considered that the alloy is useful for missile cases.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A maraging steel characterized by a combination of strength, ductility and toughness as determined by the charpy-V-notch impact test, the CVN impact energy level being at least 10–15+ ft/lbs, said steel consisting of about 17 to 19% nickel, about 1 to 4% molybdenum, about 1.25 to 2.1% titanium, the constituents molybdenum and titanium being correlated such that when the molybdenum content is below about 1.5% the titanium content is at least 1.8% and when the titanium content is below about 1.4% the molybdenum content is at least 2.25%, up to 0.3% aluminum, carbon present up to 0.03%, and the balance essentially iron.

2. The maraging steel of claim 1 in which the molybdenum is from 2 to 3.5% and titanium is from about 1.4 to 1.7%.

3. A maraging steel characterized by a combination of high yield strength, ductility and good toughness as determined by the charpy-V-notch impact test, the CVN impact energy level being at least 10–15+ ft/lbs, said steel consisting of from 16.5 to less than 19% nickel, molybdenum from 1% and up to 4%, about 1.25 to 2.5% titanium, the constituents molybdenum and titanium being correlated such that when the molybdenum content is below about 1.5% the titanium content is at least 1.8% and when the titanium content is below about 1.4% the molybdenum content is at least 2.25%, up to 1% aluminum, up to 0.05% carbon, up to 2% each of vanadium, tantalum and tungsten, up to 0.25% each of calcium, magnesium, zirconium and boron, up to 1% each of manganese and silicon and the balance essentially iron.

4. A maraging steel characterized, in the absence of cobalt, by a high yield strength on the order of 240,000–250,000+ psi together with, at such strength levels, good toughness as determined by the charpy-V-notch impact test, the CVN impact energy level being at least about 10–15+ ft/lbs at the strength level of 240,000 psi, said steel consisting of about 17% to 19% nickel, about 2% to 3.5% molybdenum, about 1.25% to about 1.7% titanium, a deoxidizing amount of aluminum up to about 0.15%, up to about 0.03% carbon, and the balance essentially iron.

* * * * *